US005662967A

United States Patent [19]

Ouyang

[11] Patent Number: 5,662,967

[45] Date of Patent: Sep. 2, 1997

[54] NON-CHROMIUM PASSIVATION METHOD FOR GALVANIZED METAL SURFACES

[75] Inventor: Jiangbo Ouyang, Flemington, N.J.

[73] Assignee: BetzDearborn Inc., Trevose, Pa.

[21] Appl. No.: 657,121

[22] Filed: Jun. 3, 1996

[51] Int. Cl.[6] ..... B05D 1/36; B05D 1/38; B05D 7/14

[52] U.S. Cl. ..... 427/409; 427/406

[58] Field of Search ..... 427/409, 385.5, 427/388.2, 433, 406

[56] References Cited

U.S. PATENT DOCUMENTS

| | | | |
|---|---|---|---|
| 2,958,611 | 11/1960 | Ulrich . | |
| 3,813,985 | 6/1974 | Perkins . | |
| 3,891,471 | 6/1975 | Summers et al. | 427/409 |
| 4,190,693 | 2/1980 | Martorano et al. | 427/428 |
| 4,781,988 | 11/1988 | Rusek et al. | 428/450 |
| 4,981,891 | 1/1991 | Felter et al. | 524/247 |
| 5,045,361 | 9/1991 | Kerherve | 427/399 |
| 5,312,652 | 5/1994 | Antoine | 427/387 |
| 5,344,505 | 9/1994 | Ouyang et al. | 148/261 |
| 5,356,490 | 10/1994 | Dolan et al. | 427/435 |
| 5,518,770 | 5/1996 | Goliaszewski et al. | 427/378 |

*Primary Examiner*—Diana Dudash
*Attorney, Agent, or Firm*—Alexander D. Ricci; Richard A. Paikoff

[57] ABSTRACT

A non-chrome, substantially siloxane free composition and method for passivating a galvanized metal surface is disclosed. The passivation treatment includes an alkyl methacrylate polymer.

20 Claims, No Drawings

NON-CHROMIUM PASSIVATION METHOD FOR GALVANIZED METAL SURFACES

FIELD OF THE INVENTION

The present invention relates to a method for passivating a galvanized coating on a metal substrate. More particularly, the present invention relates to a treatment of a galvanized or Galvalume (trademark of Bethlehem Steel Corporation) metal surface to inhibit corrosion without painting.

BACKGROUND OF THE INVENTION

The purposes for the formation of a chromate conversion coating on the surface of galvanized metal are to provide corrosion resistance, improve adhesion of coatings and for aesthetic reasons. Chromate passivation of a galvanized steel surface is done to provide corrosion resistance and for aesthetic reasons on materials which are not to be painted. A bulky, white corrosion product may form on an unprotected bright zinc surface when it becomes wet. This corrosion product is a mixture of zinc carbonate and zinc oxide or hydroxides resulting from zinc oxidation. The conditions producing the "humid storage" stain (so called white rust) most frequently occur in shipment and during storage, especially when daily temperature variations cause atmospheric water vapor to condense on a zinc surface. Likewise, black stains form on unprotected Galvalume. Galvalume is a trademark of the Bethlehem Steel Corporation for a zinc-aluminum galvanized coating over steel.

Chrome based passivation treatments are applied to galvanized metals and Galvalume to provide both long term and short term corrosion protection. A chromate treatment is typically provided by contacting galvanized metal with an aqueous composition containing hexavalent and trivalent chromium ions, phosphate ions and fluoride ions. Growing concerns exist regarding the pollution effects of chromates and phosphates discharged into rivers and waterways by such processes. Because of the high solubility and the strongly oxidizing character of hexavalent chromium ions, conventional chromate processes require extensive waste treatment procedures to control their discharge. In addition, the disposal of the solid sludge from such waste treatment procedures is a significant problem.

SUMMARY OF THE INVENTION

The present invention comprises a composition and method for treating the surface of galvanized metal to provide for the passivation of the metal surface. The coating formed by the present invention is dried in place. The method of the present invention comprises treating a galvanized metal surface with a non-toxic and low-vapor pressure treatment solution containing an alkyl methacrylate polymer. The treatment solution is substantially free of chromium and siloxanes. By substantially free of chromium and siloxanes, it is meant that neither of these materials are added to the system.

DETAILED DESCRIPTION OF THE PREFERRED EMBODIMENTS

The present inventor has discovered that a galvanized coating on metal can be passivated so as to provide corrosion resistance with a substantially chromium free treatment solution. As used herein, galvanized includes Galvalume®, a trademark of Bethlehem Steel for zinc-aluminum galvanized metal.

The treatment solution of the present invention is a non-toxic and low-vapor pressure solution including an alkyl methacrylate polymer, with a copolymer of methyl and butyl methacrylates being preferred. The treatment solution may be applied by any convenient means including spraying, dip-squeegeeing, flow coating, and roll coating. The method of the present invention comprises treating a galvanized metal surface with a treatment solution including an alkyl methacrylate polymer, e.g., a copolymer of methyl and butyl methacrylates. The treatment solution is substantially free of chromium and siloxanes. By substantially free of chromium and siloxanes it is meant that neither of these materials are added to the system.

The copolymer can be essentially methyl or butyl methacrylate (i.e., a homopolymer of each), and preferably has a methyl/butyl ratio of from about 9:1 to 1:9, with a ratio of about 5:1 to 1:5 being particularly preferred. The molecular weight of the copolymer may be from about 1,000 to 1,000,000, with a preferred molecular weight of from about 2,000 to 200,000. The methyl/butyl methacrylate copolymer is insoluble in water, but dissolves in a variety of organic solvents. An ethoxyethanol is particularly preferred in this regard, as it has a relatively low toxicity and low vapor pressure (about 3.8 mm Hg at 20° C.). The concentration of the methyl/butyl methacrylate copolymer is from about 1–25% (based on the weight of said copolymer in ethoxyethanol), with a concentration of about 2–10% preferred, and a concentration of about 5% particularly preferred.

The treatment of the present invention dissolves easily in non-toxic, low vapor pressure, non-aqueous solvents, and forms uniform and transparent thin coatings on metal surfaces.

A typical treatment process employing the treatment solution of the present invention may include: cleaning the unpassivated galvanized metal or Galvalume with an alkaline or weak acid cleaner followed by ambient tap water rinsing, squeegeeing and applying the treatment solution at room temperatures. The cleaning and rinsing stages prior to treatment solution application may not be necessary if the metal surface is not heavily soiled.

The invention will now be further described with reference to a number of specific examples which are to be regarded as solely illustrative, and not as restricting the scope of the invention.

EXAMPLES

The evaluation of the ability of the compounds of the present invention to prevent corrosion in metal surfaces is made through various corrosion performance test similar to those practiced in the art. Examples of these are:

1. QCT (Cleveland Condensing Humidity): Vapor continuously condenses on passivated side of panels and drips back to hot water bath (about 130° F.). Panels are checked periodically for rust.

2. Hot Humidity: Treated panels are exposed to 100% relative humidity at 100° F. The panels are checked periodically for rust.

3. Neutral Salt Spray (NSS): Passivated panels are placed in the NSS chamber. Corrosion processes are monitored by determining white and red rust, or black stain. The percentage coverage of rust on surface is measured ("0%"=the best).

The treatment solution of the present invention was tested on hot dipped galvanized metal and Galvalume. Comparative tests were run with a commercial passivation treatment (Treatment B), which includes hexavalent chromium, phosphoric acid and trivalent chromium.

A series of organic and inorganic materials and their combinations were evaluated for their ability to prevent corrosion on various metal substrates. Among the evaluated materials were: non-emulsified or emulsified styrene/acrylate copolymers, emulsified paraffin waxes, polyacrylamide, silane/polyacrylamide blends, various tannins, various phospholipids, organo-phosphonates and polyvinyl alcohols. These materials were used either as a single stage passivation treatment or as a modifier of a commercial non-chrome passivation treatment. None of these materials provided adequate protection to metal substrates. A series of acrylic resins obtained from ICI Acrylic, Inc. were dissolved in ethoxyethanol and evaluated. Effective corrosion resistance was obtained when the solutions were applied to various metal substrates. After cleaning with a commercial alkaline cleaner at 130° F. for 10 seconds, rinsing and squeegeeing, Advanced Coating Technology, Inc. (ACT) G90 hot dipped galvanized metal (HDG) was treated with Elvacite 2614 (or Treatment A), a commercial methyl/butyl methacrylate solution in ethoxyethanol. A hydrophobic coating was obtained. The corrosion prevention ability of the coating was evaluated using industry standard corrosion tests. The results of 5% Elvacite 2614 coated HDG and Galvalume are shown in Tables I and II, respectively.

TABLE I

Corrosion Resistance of Passivated ACT G90 HDG

| | Rust Coverage in QCT (%) | Rust Coverage in NSS (%) | |
|---|---|---|---|
| Treatment | 6 Days | 3 Days | 6 Days |
| 5% Treatment A | 0 | 100 WR | 50 RR |
| 2% Treatment B | 0 | 100 WR | 25 RR |

In all Tables:
WR: White rust; RR: Red rust

TABLE II

Corrosion Resistance of Passivated Galvalume

| | Rust Coverage in QCT (%) | Rust Coverage in NSS (%) | |
|---|---|---|---|
| Treatment | 6 Days | 3 Days | 6 Days |
| 5% Treatment A | 0 | 5 DR | 5 DR |
| 2% Treatment B | 100 | 0 DR | 40 DR |

DR: Dark rust

A methyl/butyl methacrylate/ethoxyethanol solution was applied to electrogalvanized metal and hot-dipped galvanized metals obtained from several customer process lines after the metals were cleaned, rinsed and squeegeed using similar settings described above. Elvacite 2614 was effective in providing corrosion inhibition performance on electrogalvanized metal; substantially no corrosion was observed after a 13 day test. Table III compares Elvacite 2614 with Treatment B on a thick gauge hot-dipped galvanized metal for corrosion resistance in both a Cleveland Condensing Humidity Test (QCT) and neutral salt spray (NSS).

TABLE III

Corrosion Resistance of Passivated Thick Gauge HDG

| | Rust Coverage in QCT (%) | Rust Coverage in NSS (%) | |
|---|---|---|---|
| Treatment | 6 Days | 3 Days | 7 Days |
| 5% Treatment A | 2 WR | 100 WR | 2 RR |
| 2% Treatment B | 100 WR | 100 WR | 2 RR |

In additional tests, formed cold rolled steel from a customer production line was cleaned with a commercial alkaline cleaner for 40 seconds at 150° F., rinsed and immersed in an oxidizing bath at ambient temperature, immersed in 5% Elvacite 2614 ethoxyethanol solution, and dried at 160° F. The treated cold rolled steel objects were placed in a hot-humidity chamber. Approximately 5% surface area of the object was covered by red rust, as compared to 30–100% of red rust coverage on the same objects treated with various other non-Cr materials including polyacrylamide, silane, vinyl alcohol/vinylamide copolymer, and urethane/acrylate copolymer.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for passivating a galvanized metal surface comprising contacting the galvanized surface with a treatment solution containing an alkyl methacrylate polymer, wherein said treatment solution is substantially free of chromium and siloxanes.

2. The process as recited in claim 1 wherein the alkyl methacrylate polymer is a methyl/butyl methacrylate copolymer.

3. The process as recited in claim 2 wherein the molecular weight of said copolymer is from about 1,000 to 1,000,000.

4. The process as recited in claim 3 wherein the molecular weight of said copolymer is from about 2,000 to 200,000.

5. The process as recited in claim 2 wherein the methyl/butyl ratio of said copolymer is from about 9:1 to 1:9.

6. The process as recited in claim 5 wherein the methyl/butyl ratio of said copolymer is from about 5:1 to 1:5.

7. The process as recited in claim 1 wherein the alkyl methacrylate polymer is a methyl methacrylate homopolymer.

8. The process as recited in claim 1 wherein the alkyl methacrylate polymer is a butyl methacrylate homopolymer.

9. The process as recited in claim 2 wherein the methyl/butyl methacrylate copolymer is dissolved in ethoxyethanol.

10. The process as recited in claim 9 wherein the concentration of the methyl/butyl methacrylate copolymer is from about 1–25%.

11. The process as recited in claim 10 wherein the concentration of the methyl/butyl methacrylate copolymer is from about 2–10%.

12. The process as recited in claim 11 wherein the concentration of the methyl/butyl methacrylate copolymer is about 5%.

13. A process for passivating a galvanized metal surface consisting essentially of contacting the galvanized surface with a treatment solution containing an alkyl methacrylate copolymer, wherein said treatment solution is substantially free of chromium and siloxanes.

14. The process as recited in claim 13 wherein the alkyl methacrylate polymer is a methyl/butyl methacrylate copolymer.

15. The process as recited in claim 14 wherein the molecular weight of said copolymer is from about 1,000 to 1,000,000.

16. The process as recited in claim 15 wherein the molecular weight of said copolymer is from about 2,000 to 200,000.

17. The process as recited in claim 14 wherein the methyl/butyl ratio of said copolymer is from about 9:1 to 1:9.

18. The process as recited in claim 17 wherein the methyl/butyl ratio of said copolymer is from about 5:1 to 1:5.

19. The process as recited in claim 13 wherein the alkyl methacrylate polymer is a methyl methacrylate homopolymer.

20. The process as recited in claim 13 wherein the alkyl methacrylate polymer is a butyl methacrylate homopolymer.

* * * * *